US005492504A

United States Patent [19]

Wolters

[11] Patent Number: 5,492,504

[45] Date of Patent: Feb. 20, 1996

[54] POCKET PORTABLE COIN DISPENSER

[76] Inventor: Charles P. Wolters, 578 N. Laclede Station Rd., Saint Louis, Mo. 63119-2020

[21] Appl. No.: 323,778

[22] Filed: Oct. 17, 1994

[51] Int. Cl.[6] ..... G07D 1/00

[52] U.S. Cl. ..... 453/54; 206/0.84; 221/279

[58] Field of Search ..... 453/48, 51–54; 221/279, 280; 206/0.81, 0.83, 0.84

[56] References Cited

U.S. PATENT DOCUMENTS

| | | | |
|---|---|---|---|
| 987,369 | 3/1911 | Jamison et al. . | |
| 1,030,092 | 6/1912 | Joseph . | |
| 1,235,910 | 8/1917 | Miller | 453/54 |
| 1,256,375 | 2/1918 | Ruby | 453/54 |
| 1,844,285 | 2/1932 | Johnson | 221/279 X |
| 2,334,016 | 11/1943 | Loesch | 453/54 |
| 2,654,376 | 10/1953 | Hultberg | 453/54 |
| 2,863,464 | 12/1958 | Hewitt et al. . | |
| 3,255,767 | 6/1966 | Mickelson . | |
| 3,675,664 | 7/1972 | Kitowski | 453/54 |
| 3,731,695 | 5/1973 | Meijer | 453/54 |
| 5,024,629 | 6/1991 | Murry | 453/54 |
| 5,026,321 | 6/1991 | Benson | 453/54 |
| 5,267,893 | 12/1993 | Mangigian | 453/54 |

*Primary Examiner*—F. J. Bartuska

[57] ABSTRACT

The invention involves a coin dispenser that can be carried in its user's clothing pocket, and has multiple chambers for holding coins with their faces parallel to the dispenser's largest face. Each chamber holds its coins in a stack. Each stack is urged upward by a follower and spring toward a pair of opposing retaining ledges at the top of the dispenser. Each follower has a center stub on its spring side which is guided in a hole in the dispenser's bottom. This guidance reduces the coverage of a top coin needed by the pair of ledges. The reduced coverage provides improved access of a user's finger or thumb to the top coin for pushing it radially through an opening and out of the dispenser. Each guided follower also prevents a top coin from tilting its edge away from its opening or a user's pushing finger. Each chamber has a trough cutting into it, opposite the opening, which aids the user's finger access to a top coin. The trough also gives the user a view of the edges of all the coins in the chamber for counting them. The dispenser can be spun in the fingers to quickly access other coin chambers. The dispenser has a snap-on bottom cover that is contoured to approximate the shape of the user's body when carried in his or her clothing pocket.

12 Claims, 3 Drawing Sheets

POCKET PORTABLE COIN DISPENSER

FIELD OF INVENTION

The invention pertains to coin dispensers, and more particularly to those carried in a person's clothing pocket which have their coins dispensed directly by a user's finger or thumb.

BACKGROUND ART

The most commonly available coin dispensers have a basic structure like that found in U.S. Pat. No. 5,267,893 to Gretel C. Mangigian, which issued Dec. 7, 1993. Such dispensers use a crescent-shaped ledge at the top of each chamber, opposite an ejection opening, to retain the coins. Each chamber typically contains a plate-like follower over a compression spring for pushing a stack of coins upward against the ledge. This thin follower will tilt easily with pressure from a user's finger. The crescent-shaped ledge leaves the face of the top or outermost coin exposed for finger contact, and still retains the follower from ejecting when it is tilted.

However, the crescent-shaped ledge limits the contact of the user's finger to only the face of the coin. Sweaty fingers or dirty coins, which stick together, can easily prevent dependable ejection of the coins. The ledge, being opposite the opening, often directs more finger pressure toward the opening side of the chamber. This causes the follower and coins to tilt down on the opening side of the chamber when the user tries to remove a coin. When the bottom surface of the outermost coin tilts below the bottom surface of the opening, the coin is blocked from ejecting. As the stack of coins gets taller, the tilting problem is reduced because the friction between the coins resists the tilting of the coins, and the stack itself then acts like a thick follower. This is a reason why so many available dispensers hold a large quantity of coins like Mangigian's dispenser. Such a unit, when fully loaded, would not only be too bulky, but also too heavy to be comfortable in a user's pocket.

In U.S. Pat. No. 1,235,910, which issued Aug. 7, 1917 to Edgar F. Miller, the obstructing ledge and tilting follower problems were solved by using thick cup-shaped, and therefore tiltless, followers in the coin chambers. These cup-shaped followers also add undesired bulk to the dispenser. Both Mangigian's dispenser and Miller's dispenser have their thinnest overall dimension thicker than the diameter of the largest coin which they hold.

U.S. Pat. No. 2,334,016, which issued Nov. 9, 1943 to Richards L. Loesch, describes a pocket size coin dispenser that has the crescent-shaped ledge on the opening or slot side of each coin chamber. This helps a user's finger start an outermost coin into the slot. But the coin may still tilt down opposite the slot, pulling its edge away from an ejecting finger. This makes it difficult to eject a coin through its exit slot. Also, the slot-sided ledge is an obstruction in the direct path of the user's pushing finger. This causes the ejecting coin to stop before it is completely separated from the dispenser.

U.S. Pat. No. 5,026,321, which issued Jun. 25, 1991 to Anders B. Benson, shows a pocket carried coin dispenser with two opposing ledges over each coin chamber which are parallel to a coin's path through its opening. This leaves some finger access to the edge of the outermost coin, opposite the opening, for pushing out the coin. These ledges protrude far toward the center of their coin chamber, and therefore help to retain the plate-like follower when it is tilted. The more these ledges cover the top coin, the more they obstruct the user's finger. With Benson's dispenser the coins can still tilt their edges away from an ejecting finger.

Another disadvantage of the pocket size dispensers of Loesch and Benson is that they have flat bottoms and small radii between their bottoms and sides. These bottom corners are easily visible through a user's clothing pocket, and make their dispenser uncomfortable to keep in a pocket.

A further disadvantage of all of the aforementioned patents is that none of them have a provision that allows a user to view the entire coin content of the dispenser. This prevents the user from counting the coins without removing them.

OBJECTS AND SUMMARY

In today's market place, where lasers are used to add up a buyer's purchases, a cash check-out line moves very fast until a buyer fumbles through his loose change. Though many coin dispensers are available, they are seldom used to make everyday purchases due to the aforementioned problems. The objects of the present invention are directed at solving these problems in order to create a coin dispenser which would be more accepted in the market place.

The first object of the invention is to provide a dispenser with opposing coin retaining ledges that are narrow and aligned in the same direction as the coins' paths through enter/exit openings. Such ledges will leave ample coin access for a user's ejecting finger or thumb to push coins out of the dispenser.

The second object is to provide a dispenser that has coin followers which are guided from tilting. This will prevent the edge of an outermost coin from tilting away from an exit opening or an ejecting finger. It will also prevent the coin's follower from rocking over opposing retaining ledges.

The third object is to provide a dispenser that can be made thinner than the diameter of the smallest diameter coin that the dispenser holds. This will make it lightweight and easily pocket portable.

The fourth object is to provide a pocket portable coin dispenser with a generally convex surface which approximates the contour of a user's body when carried in his or her clothing pocket.

The fifth object is to provide a dispenser in which the edges of all of the coins that it can hold are visible for counting.

In addition to the advantages discussed over prior art, the pocket portable dispenser of the invention has two more benefits. One is that it is structured to be held at its center between a finger and thumb, and spun around with another finger of the same hand to quickly access other coin chambers. The other benefit is that rapid and economical assembly of the dispenser is provided by a snap-on cover.

There are prior art coin dispensers that can claim some of the above advantages. But what makes all of these advantages possible with one dispenser is the unique structure of the present invention. With this dispenser each coin is ejected in one straight motion with such dependability that its user can dispense change as quickly as a cashier can pull change out of a cash drawer. This is accomplished without its user having to carry a bulky and uncomfortable dispenser in his or her pocket.

The dependable coin ejection is made possible by obtaining extra finger access to the top or outermost coins, and by not allowing those coins to tilt away from the user's pushing finger or the coin's exit opening. What permits the extra finger access and keeps the coins from tilting, is that each coin follower is kept from tilting by its piston rod-like appendage, or stub, that slides in a guiding hole in the dispenser's bottom cover. If a follower cannot tilt, then it cannot rock around a ledge that extends less than one hundred and eighty degrees around the top of the coin chamber. Therefore a ledge need not be crescent-shaped, and can be in the form of a pair of short straight narrow opposing ledges. In the preferred embodiment of the invention, these ledges run parallel to the path of a coin passing radially through an opening under the ledges. This arrangement gives an ejecting finger or thumb much improved access to a top or outermost coin's edge over the prior art crescent-shaped ledge.

Most purchases made by the public only require that the buyer give coins to change the smallest denomination of paper currency, or to receive the same. Therefore a pocket portable coin dispenser need only dispense or accept the same. The preferred embodiment of the invention holds the four different coins most commonly used in American purchases in quantities of at least one less than required to equal the next larger denomination currency. The guided appendage on each follower needs to be slightly longer than the stroke length of the follower so the appendage does not come out of its hole. But the stacks of coins and stroke lengths are short enough that the followers of the preferred embodiment are shorter than cup-shaped prior art followers for the same coins. The small capacity of the dispenser of the invention, and the unique shape of its coin followers, permit not only a thin and lightweight dispenser, but also one that can be contoured to approximate its user's body curvature when carried in his or her clothing pocket.

Also, the invention dispenser has its coin chambers partially cut away to expose the edges of all coins held within. These cuts or view troughs give the user the ability to count the coins, but they don't effectively weaken the dispenser. They also aid the access of an ejecting finger to the outermost coins.

A better understanding of the details and benefits of the present invention can be attained by referring to the drawings and the ensuing description.

DRAWING FIGURES

PART NUMBERS

Additional numbers with prime marks that are listed with one part name refer to modified versions of that part.

| | |
|---|---|
| 20, 20' | body |
| 22, 22' | cover |
| 24D, 24D' | dime chamber |
| 24N | nickel chamber |
| 24P, 24P' | penny chamber |
| 24Q, 24Q' | quarter chamber |
| 26D | dime |
| 26N | nickel |
| 26P | penny |
| 26Q | quarter |
| 28, 28' | floor |
| 30D, 30D' | dime follower |
| 30N | nickel follower |
| 30P, 30P' | penny follower |
| 30Q, 30Q' | quarter follower |
| 32D, 32D' | dime plate |
| 32N | nickel plate |
| 32P, 32P' | penny plate |
| 32Q, 32Q' | quarter plate |
| 34, 34' | hollow |
| 36, 36', 36", 36"' | stub |
| 38 | relief |
| 40P | penny sticker |
| 40Q | quarter sticker |
| 42, 42', 42", 42"' | hole |
| 44, 44' | sleeve |
| 46, 46' | spring |
| 48 | sink |
| 50, 50' | ledge |
| 52 | ridge |
| 54 | shelf |
| 56 | land |
| 58 | notch |
| 60, 60' | trough |
| 62 | side |
| 64, 64' | bevel |
| 66 | cone |
| 68, 68' | cavity |
| 70 | rabbet |
| 72 | groove |
| 74, 74' | rim |
| 76 | lip |
| 78 | dimple |
| 80 | cutout |
| 82 | crimp |

DESCRIPTION AND OPERATION

Figure 1:
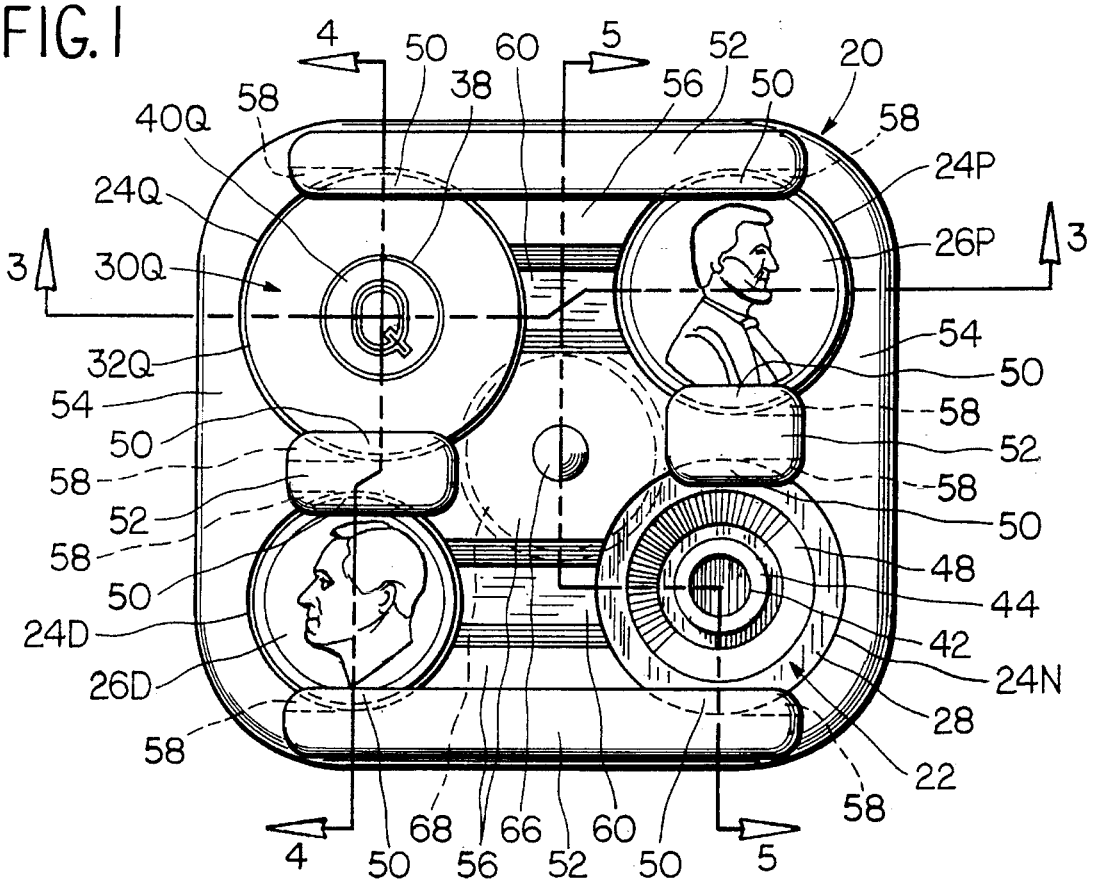
FIG. 1 is a plan view of the dispenser of the invention.
Figure 3:
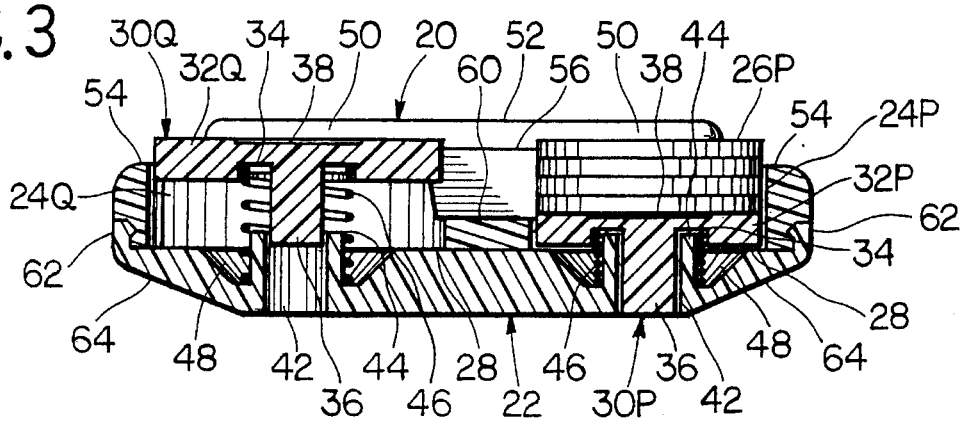
FIG. 3 is a cross-sectional view taken on the line 3—3 of FIG. 1.
Figure 4:
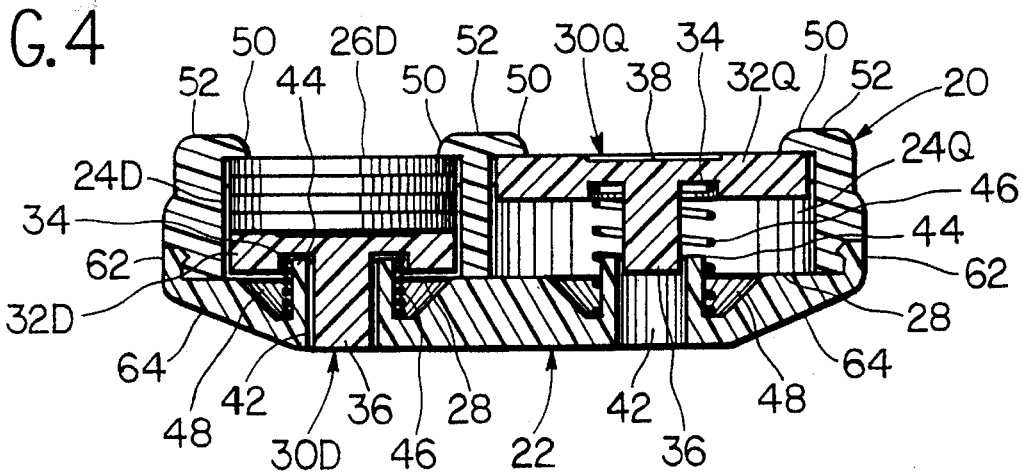
FIG. 4 is a cross-sectional view taken on the line 4—4 of FIG. 1.
Figure 5:
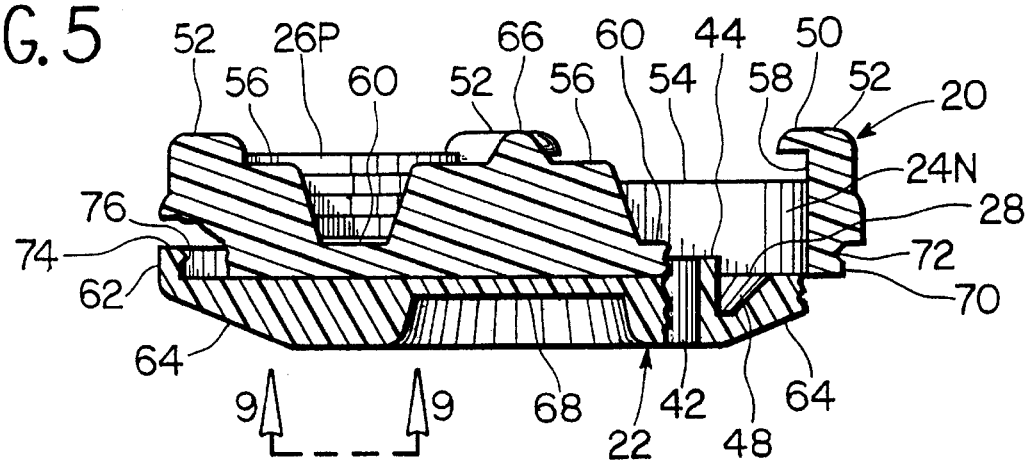
FIG. 5 is an offset sectional view taken on the line 5—5 of FIG. 1 with portions broken away.

FIG. 1 is a plan view of the preferred embodiment of the invention. FIGS. 3, 4, and 5 are elevated sections about their respective lines 3—3, 4—4, and 5—5 in FIG. 1. These figures show a coin dispenser having a body 20 and a bottom cover 22 which are molded of plastic.

FIG. 1 shows, within body 20, four cylindrical coin holding chambers which are identified as a dime chamber 24D, a nickel chamber 24N, a penny chamber 24P, and a quarter chamber 24Q. Each of chambers 24D, 24N, 24P, and 24Q has a diameter slightly larger than that of the coin it is designed to hold. Within chambers 24D, 24N, 24P, and 24Q, coins are axially movable and capable of being stacked face to face. A dime 26D is visible in dime chamber 24D, and a penny 26P is visible in penny chamber 24P. Nickel chamber 24N is shown empty in order to expose a floor 28 and other sub-parts of cover 22. Quarter chamber 24Q is shown without coins and containing a quarter follower 30Q. To enable a better view of its sub-parts, a nickel follower 30N is shown alone in an elevated section in FIG. 2. A complete dispenser would, of course, contain nickel follower 30N within nickel chamber 24N. A penny follower 30P is shown sectioned in FIG. 3 along with quarter follower 30Q. A dime follower 30D is sectioned in FIG. 4. Coins are not sectioned in the drawing figures. FIGS. 3, 4, and 5 show floor 28 at the bottom end of chambers 24D, 24N, 24P, and 24Q.

Figure 2:
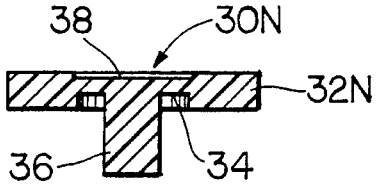
FIG. 2 is an elevated section of a coin follower of the dispenser.

Referring to FIG. 2, nickel follower 30N:

(a) is molded of plastic;

(b) has a corresponding plate 32N which slides free in its corresponding nickel chamber 24N (not shown in FIG. 2);

(c) has a round coaxial bottom hollow 34;

(d) has an integrally molded and coaxially located cylindrical stub 36 protruding down from hollow 34; and (e) has a shallow round coaxial top relief 38. Followers 30D, 30P, and 30Q have the same construction as nickel follower 30N. All of their hollows 34, stubs 36, and reliefs 38 are the same size. Top relief 38 is for the placement of a denomination identification. A quarter sticker 40Q is shown in FIG. 1, on quarter follower 30Q, within relief 38.

Referring to FIGS. 2–5, each stub 36 slides in a hole 42. Hole 42 is coaxially located inside a sleeve 44, which is integrally molded with cover 22. Each sleeve 44 is coaxially located with its chamber 24D, 24N, 24P, or 24Q. Holes 42 guide stubs 36 to maintain plates 32D, 32N, 32P, and 32Q square with their corresponding chambers 24D, 24N, 24P, and 24Q. This means followers 30D, 30N, 30P, and 30Q cannot tilt when in the dispenser. Closely surrounding each sleeve 44 is a coil compression spring 46 (not shown in FIG. 5) which pushes up on each follower 30D, 30N, 30P, and 30Q. The top of spring 46 is guided by hollow 34. Sleeve 44 bottoms in the center of a sink 48 in floor 28. The outside surface of sleeve 44 has a height slightly longer than the compressed length of spring 46. Sleeve 44 extends above floor 28 an amount equal to the depth of hollow 34. Each of followers 30D, 30N, 30P, and 30Q, or the top coin above it, abuts against a pair of narrow retaining ledges 50. A stroke length of each follower 30D, 30N, 30P, and 30Q is determined by taking the distance between floor 28 and ledge 50, and then subtracting the thickness of the corresponding plate 32D, 32N, 32P, or 32Q. The stroke lengths vary slightly because plates 32D, 32N, 32P, and 32Q vary slightly in thickness. This is to accommodate different maximum stack heights of coins. The stroke lengths are slightly longer than the maximum stack heights. The maximum stacks are four dimes 26D, three nickels 26N, four pennies 26P, and three quarters 26Q. Nickel 26N and quarter 26Q are not shown in FIGS. 2–5. Hole 42, sleeve 44, and spring 46 are the same size under all followers 30D, 30N, 30P, and 30Q. All holes 42 pass completely through cover 22. The distance that sleeve 44 extends above the bottom surface of cover 22 is slightly longer than the longest stroke length, which is of penny follower 30P. The axial length of stub 36 is longer than the distance that sleeve 44 extends above the bottom surface of cover 22 an amount equal to the amount that a stroke length is longer than the corresponding stack height. These measurements determine that, for all followers 30D, 30N, 30P, and 30Q, stub 36 will not be pushed out of its sleeve 44, and will be flush with the bottom surface of cover 22 when its chamber 24D, 24N, 24P, or 24Q is full of coins.

Four ridges 52 extend upward from body 20 and are aligned left to right as viewed in FIG. 1. The parts of ridges 52 which appear to be cut away by the tops of chambers 24D, 24N, 24P, and 24Q are ledges 50. Ledges 50 are parallel because all ridges 52 are parallel. Beneath ridges 52 on body 20 is a shelf 54. Also beneath ridges 52 on body 20 is a land 56. Shelf 54 and land 56 can only be viewed in FIGS. 1, 3, and 5. FIG. 1 shows that shelf 54 is divided into two parts by ridges 52, land 56, and chambers 24D, 24N, 24P, and 24Q. Shelf 54 and land 56 denote the largest orthogonal face of the dispenser. Note that the coins are held parallel to the surfaces of this face.

Referring to FIGS. 3, 4, and 5, the vertical thickness of ledge 50 is approximately the thickness of penny 26P. The maximum radial protrusion of ledge 50 into its chamber 24D, 24N, 24P, or 24Q is between one and two times this thickness, and is generally proportional to the diameter of its chamber 24D, 24N, 24P, or 24Q. The vertical distance between ledge 50 and shelf 54 is greater than the thickness of the thickest coin, nickel 26N, and less than twice the thickness of the thinnest coin, dime 26D, that can be carried in the dispenser. Land 56 is recessed in body 20 below ledge 50 a vertical distance of approximately one half the thickness of penny 26P, which is less than the thickness of any coin to be carried. This helps to keep the coins from climbing onto land 56.

Coin enter/exit openings can be seen in FIGS. 1 and 5. Each opening is established in chambers 24D, 24N, 24P, and 24Q by a pair of notches 58 which are tangent to their corresponding chamber 24D, 24N, 24P, or 24Q, and parallel to ridges 52. Notch 58 extends vertically between ledge 50 and shelf 54. Each notch 58 is therefore under an end of each ledge 50 that is toward the outside of the dispenser and opposite land 56. Plates 32D, 32N, 32P, and 32Q are all thicker than the height of notches 58 so that they cannot exit their chambers 24D, 24N, 24P, or 24Q through the openings. Reference must also be made to FIGS. 2, 3, and 4 in order to check this measurement.

Thus the coin loading can now be understood by viewing FIG. 3. Follower 30Q is depressed beneath shelf 54 by a user's finger (not shown) or quarter 26Q (not shown in FIG. 3). Quarter 26Q can then be slid over shelf 54 and follower 30Q, and under pair of ledges 50 (only one is shown in FIG. 3) to enter chamber 24Q from the left of the dispenser. Quarter 26Q must then be depressed with follower 30Q to allow the next quarter 26Q to be loaded into chamber 24Q. Chambers 24D, 24N (neither are shown in FIG. 3) and 24P are loaded in the same manner as chamber 24Q until they become full of their appropriate coins.

FIG. 1 shows that land 56 is divided into three parts by two troughs 60 which are aligned parallel to ledges 50 and ridges 52. Each trough 60 cuts into and connects a pair of chambers 24D and 24N, or 24P and 24Q. Troughs 60 are narrower than the diameter of any chamber 24D, 24N, 24P, or 24Q in order to prevent any coin from entering them.

In order to eject coins, the dispenser is held in its user's hand so that it can be viewed as in FIG. 1. For example, if dime 26D is desired to be dispensed and the dispenser is in the user's right hand, the thumb of the same hand can be brought around the right of the dispenser. No hand or thumb is shown in the drawing figures. The thumb is placed over trough 60 which connects chamber 24D. As the thumb is pushed toward the left, it will catch the edge of dime 26D, and push it in a radial direction beside pair of ledges 50, and through pair of notches 58 to exit chamber 24D and the dispenser. If the user's hand is large enough and the dispenser is in the fingers of his or her hand, the thumb can eject penny 26P without the dispenser being turned around. To do this, the thumb is placed over trough 60 which connects chamber 24P, and pulled toward the user's wrist (not shown). Penny 26P will drop into the palm of the same hand when it leaves the dispenser. The user's thumb moves in only one straight motion to eject a coin from any chamber 24D, 24N, 24P, or 24Q. Ledges 50 do not obstruct the thumb because they are aligned parallel to the coin's path, and they are narrow. This is the first object of the invention. Ridges 52 help guide the thumb's movement when ejecting coins.

As can be seen by referring to FIG. 3, when a coin is ejected, it cannot tilt and pull its edge away from the thumb because stubs 36 and holes 42 will not allow followers 30P, and 30Q to tilt. The same is true for followers 30D and 30N which are not shown in FIG. 3. If a hasty user positions his or her thumb on top of the coin and between pair of notches 58 (see FIG. 1) before pushing, the coin cannot tilt its edge below shelf 54 and be blocked from ejecting. If followers 30D, 30N, 30P, and 30Q cannot tilt, then they cannot rock around their narrow retaining ledges 50 to climb out of the dispenser. Keeping followers 30D, 30N, 30P, and 30Q from tilting is the second object of the invention.

The thinness of the preferred embodiment can be easily seen by referring to FIG. 4. Measure the diameter of dime 26D and the overall thickness or height of the dispenser. Relating to the third object of the invention, it will be observed that the dispenser is thinner than the diameter of dime 26D which is the smallest coin the dispenser holds.

There are three reasons why the preferred embodiment is so thin:

(f) The dispenser has a low coin capacity.

(g) Followers 30D, 30N, 30P, and 30Q can be made shorter without jamming when pushed down off center than equivalent cup-shaped followers (not shown) of the type used in U.S. Pat. No. 1,235,910. This is because a jamming torque caused by friction is greater acting on the cup-shaped follower. Experiments have revealed to the inventor that follower 30Q would jam when pushed down off center if its vertical height was shorter than as shown in FIG. 3. In FIG. 3, follower 30Q is touching an arrowhead on the lead line from its part number. A finger pushing down on follower 30Q at this arrowhead would cause stub 36 to drag hole 42 on its right portion. A cup-shaped quarter follower would have the diameter of plate 32Q, but it would be thicker. If it were pushed down in the same place as follower 30Q, its bottom edge would drag the right portion of its chamber. The chamber of the cup-shaped follower would have the same diameter as chamber 24Q. It can be seen in FIG. 3 that the right portion of hole 42 is closer to the arrowhead than the right portion of chamber 24Q. The friction of hole 42 creates a smaller torque about the arrowhead than the friction that the right portion of the chamber of the cup-shaped follower would create, because it is closer to the arrowhead. The cup-shaped quarter follower must be made taller than follower 30Q in order to compensate for the greater jamming torque which counters the downward pushing finger.

(h) When followers 30D, 30N, 30P, and 30Q are fully depressed, they don't require cover 22 to pass under the bottom of stubs 36 (note follower 30P in FIG. 3). A cup-shaped follower would require its dispenser to have the added thickness of a bottom cover under it.

As seen in FIGS. 3 and 4, cover 22 has four sides 62. FIGS. 3 and 5 show that sides 62 are perpendicular to shelf 54 and land 56 on body 20. Referring back to FIGS. 3 and 4, between each side 62 and the bottom surface of cover 22 is a bevel 64. Each bevel 64 terminates with side 62 at a level higher than the bottom of sink 48. Each bevel 64 also terminates with the bottom surface of cover 22 at a distance to each adjacent hole 42 that is less than the diameter of hole 42. Bevels 64 give the bottom of the dispenser a convex contour. This helps hide the dispenser's outline when a user carries it in a clothing pocket with bevels 64 away from his or her body. This is the fourth object of the invention. Since the clothing material (not shown) will be stretched less, the dispenser will be more comfortable to carry in a pocket with bevels 64 than without them.

Referring to FIGS. 3 and 5, each trough 60 is recessed into body 20 deeper than the bottom coin in any of chambers 24D, 24N, 24P, and 24Q when they are fully stacked with coins. Dime chamber 24D is not shown in these figures. Troughs 60 do not effectively weaken the dispenser because they are near its center, and their depth is only about half of the dispenser's thickness. Referring to FIG. 3, when a user looks down on the top of the dispenser at about forty-five degrees to the left of vertical, he or she can easily see the edges of all four pennies 26P in penny chamber 24P. At the same time, the user can view the edges of any coins in nickel chamber 24N, though it is not shown in FIG. 3. If quarter chamber 24Q was full of coins, their edges could be viewed by looking down at about forty-five degrees from the right side of vertical. Though not shown in FIG. 3, the edges of all four dimes 26D, in dime chamber 24D, would be seen when viewing the dispenser at this angle. Enabling a user to see and count all of the contained coins is the fifth object of the invention.

On land 56 and generally centered between chambers 24D, 24N, 24P, and 24Q is a round protrusion or blunt cone 66 as shown in FIGS. 1 and 5. The top of cone 66 is level with the tops of ridges 52. Axially centered with cone 66 is a round cavity 68 in the bottom of cover 22. When ejecting coins, a user may desire to turn the dispenser around so as to access a different pair of chambers 24D and 24Q, or 24N and 24P. This can quickly be done by placing his or her thumb over cone 66, placing a finger of the same hand in cavity 68, and spinning the dispenser around with another finger of the same hand. FIG. 5 shows cavity 68 being flat-topped for the placement of an advertising label (not shown).

FIG. 5 also shows body 20 partly broken away on the left, and cover 22 partly broken away on the right. This is to show how the two parts are fastened together. The bottom circumference of body 20 has a rabbet 70 with a groove 72 in its vertical portion. Sides 62 are on the outside surface of a raised rim 74 of cover 22. Opposite each side 62 on rim 74 is an inward facing lip 76. After springs 46 and followers 30D, 30N, 30P, and 30Q (not shown in FIG. 5) are mounted onto cover 22, lip 76 engages groove 72 as cover 22 is snapped onto body 20. Since no adhesives or screw fasteners are required, the assembly is fast and economical.

Figure 6:
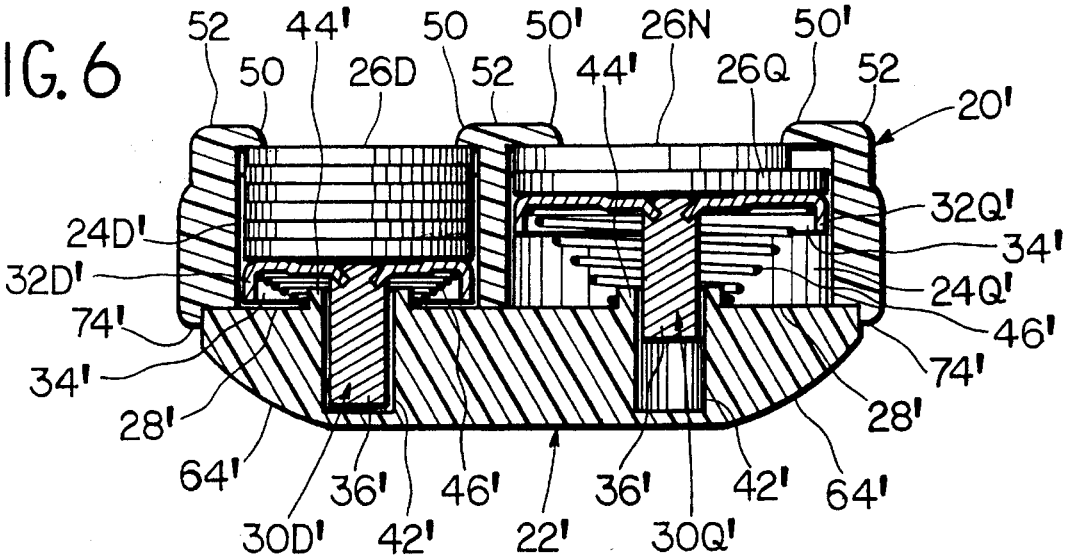
FIG. 6 shows several modifications to the dispenser in a view similar to that of FIG. 4.

Some possible modifications to the preferred embodiment described above are shown in FIGS. 6–9B. The following seven modifications refer to FIG. 6 which is a similar view to that of FIG. 4:

(i) Followers 30D' and 30Q' are made of metal. Stubs 36' are riveted to stamped metal plates 32D' and 32Q'.

(j) In order to increase the coin capacity of the dispenser, body 20' and cover 22' have been thickened, and chambers 24D', 24Q', and stubs 36', have been axially lengthened. Even though the dispenser is thicker than the diameter of dime 26D with this modification, its overall thickness is still thinner than the diameter of quarter 26Q, the largest coin carried by the dispenser. This can be measured because quarter 26Q is shown within chamber 24Q', over follower 30Q', and under nickel 26N. Stub 36' remains axially shorter than seventy percent of the diameter of the smallest plate, dime plate 32D'. This can be checked by measuring these parts in FIG. 6.

(k) The bottom of cover 22' covers over the bottom of each hole 42'.

(l) Hollow 34' is wider, sleeve 44' is shorter, and sink 48 is missing from floor 28', when using conical spring 46'. Springs 46' and hollows 34' vary in size.

(m) Ledges 50' have been widened just enough to retain coins of the next smaller diameter, except over dime chamber 24D'. This permits extra capacity for a smaller diameter coin if the dispenser lacks coins of the next larger diameter. Nickel 26N is shown off center yet still retained at the top of quarter chamber 24Q'.

(n) Bevels 64' each have a convex curved surface.

(o) Rabbet 70, groove 72, and lip 76 are removed, and rim 74' is on body 20' instead of on cover 22'.

Figure 7:
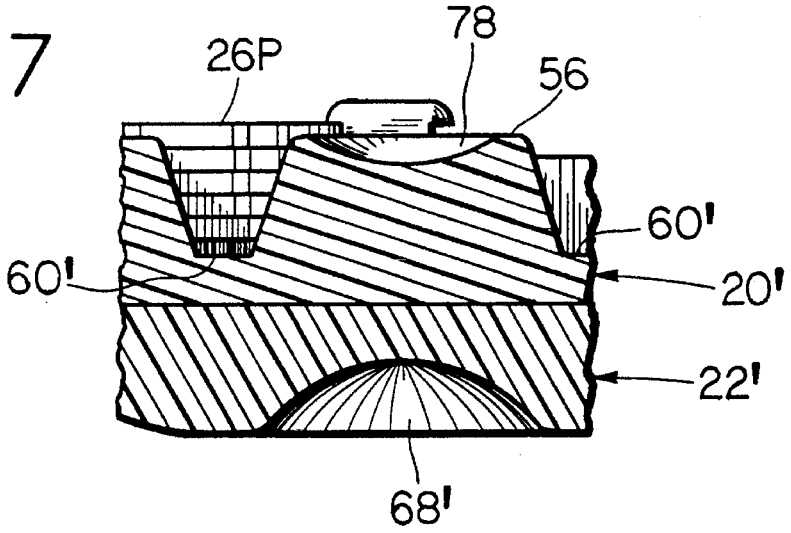
FIG. 7 is a partial section of the dispenser with modifications in a view similar to that of FIG. 5.

The following three modifications refer to the partial section in FIG. 7, which is a similar view to that of FIG. 5:

(p) Troughs 60' are deeper in order to view taller stacks of coins.

(q) Cone 66 is replaced by a dimple 78.

(r) Cavity 68' is domed instead of being flat-topped.

Figure 8:
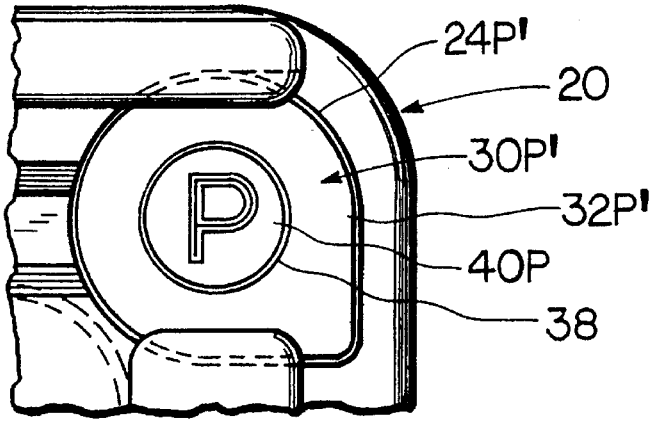
FIG. 8 is a partial plan view of the dispenser with modifications.

FIG. 8 is a partial plan view of the dispenser. A portion of body 20 is shown with pennies 26P removed from chamber 24P' to reveal a penny sticker 40P. The following modification refers to FIG. 8:

(s) Sticker 40P is kept from rotating, along with follower 30P', by plate 32P' having a squared corner that engages a mating squared corner of chamber 24P'. The squared corner gives the additional benefit of maintaining uniform wall thicknesses within body 20 in keeping with typical molding practice.

Figure 9A:
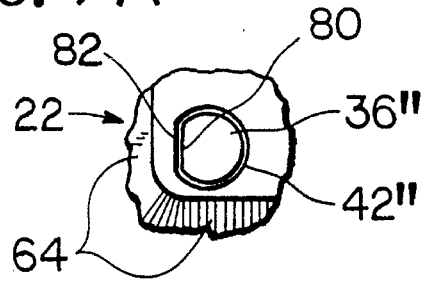
FIGS. 9A and 9B show partial views about the line of sight 9—9 in FIG. 5, each having different modifications.
Figure 9B:
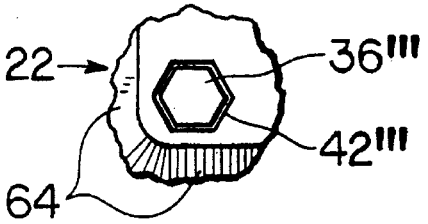

FIGS. 9A and 9B show different modifications to stub 36 and hole 42 as seen from the bottom surface of the dispenser. The partial views are taken about the line of sight 9—9 in FIG. 5. The following two modifications are both for the purpose of keeping sticker 40P (not shown) from rotating:

(t) In FIG. 9A, stub 36" has a flat cutout 80 along its full axial length that slides along a corresponding flat crimp 82 in hole 42".

(u) In FIG. 9B stub 36''' is not cylindrical, but hexagonally prismatic. Stub 36''' slides axially but does not rotate within a hexagonal hole 42'''.

Even though most of the above modifications have been grouped together in the drawing figures, the majority of them are independent of each other, and could be used individually or in combination to change the preferred embodiment.

Ramifications and Conclusion

More modifications to this invention are possible that are not shown in the drawing figures:

(v) Denomination identification stickers could be kept from rotating by any of the following four means:
- The stubs and holes could be molded slightly off center from their plates and chambers.
- The plates and chambers could have more than one mating squared corner.
- Each mated pair of squared corners could be replaced by a bump on the plate that slides in an axially aligned slot in the chamber.
- The stub could have more than one cutout, and the hole could have more than one corresponding crimp.

(w) Each ridge could contain more or less than two ledges.

(x) The plastic body, cover, and followers could have hollowed-out spaces to maintain uniform wall thicknesses as necessary for molding parts.

(y) The body, cover, and followers could be made of a different material than plastic, such as metal, wood, ceramic, or glass.

(z) The body could have a different shape, such as round with a continuous side, or that of a slim rectangle with its chambers all in one row. The body could also have an irregular shape.

(aa) There could be more or less than four chambers in the dispenser.

(bb) Each stub, hole, sleeve, or spring could be a different size under a different chamber.

(cc) The thickness of the dispenser could vary at each chamber.

(dd) The axial length of the stub could be the same length or slightly shorter instead of slightly longer than the distance that the sleeve extends above the bottom surface of the cover or the bottom of a closed hole.

(ee) The dispenser could be designed to hold different coins than dimes, nickels, pennies, or quarters.

Thus can be understood how the pocket portable coin dispenser of the invention provides improved speed and dependability of coin ejection while maintaining a thin and comfortable shape for its user's pocket. The user can easily count the coins without removing them from the dispenser. The manufacturer of the dispenser can have the economy and speed of a snap-fit assembly.

As more modifications to the invention than those shown or described will be obvious to people skilled in the art, the scope of the invention should not be limited to these embodiments, but determined by the claims which follow.

What is claimed is:

1. A coin dispenser from which a user urges out coins with his or her finger or thumb, and with which he or she can carry coins in a clothing pocket, comprising:

a body made of molded plastic, an even number of cylindrical coin holding chambers of different diameters for holding coins face to face in stacks with the coins' faces parallel to the largest orthogonal face of said body, said chambers being arranged in pairs, the coins being axially movable within said chambers, a pair of ledges opposing each other and substantially parallel to each other affixed on said body at one end of each chamber for retaining the coins, all pairs of ledges being on one face of said body, each ledge protruding partway toward the center of its chamber, an opening in each chamber for an appropriate coin to slide radially beside said pair of ledges into and out of said chamber and said body, said opening being at one end of said pair of ledges, a land on the same face of said body on which said pairs of ledges are affixed, said land being recessed into said body beyond said pairs of ledges and being at opposite ends of said pairs of ledges from said openings, said land communicating all chambers and giving access of the outermost coins' edges to the urging finger or thumb of the dispenser's user, a cover attached to the face of said body that is opposite from the face having said pairs of ledges, an overall thickness dimension of the dispenser measured from the outside of said pair of ledges to the outside surface of said cover being less than the diameter of the largest diameter coin that can be carried in the dispenser, a floor being on the inside surface of said cover and communicating with the ends of said chambers which are opposite said pairs of ledges, a substantially circular plate inside each chamber having a diameter slightly smaller than the diameter of its surrounding chamber, said plate located in-between said pair of ledges and said floor, a coil compression spring inside each chamber located in-between said floor and said plate for urging coins against said pair of ledges, a substantially cylindrical stub being coaxially fixed to the face of each plate which is adjacent said spring, said stub having an axial length of less than seventy percent of the diameter of the affixed plate, a sink centered with each chamber being in said floor, a sleeve fixed to the center of each sink, coaxial with each chamber and being inside each spring, and a hole passing through and coaxial with each sleeve, said hole continuing through said cover and having a diameter slightly larger than the diameter of said stub, said stub being engaged with and axially slidable with said hole, said sleeve having a sufficient axial length whereby said sleeve and said cover substantially encompass said stub when said plate is depressed completely toward said floor, said stub and said hole being for the maintaining of said plate square with its surrounding chamber.

2. The coin dispenser of claim 1, further including:

a trough in said land connecting each pair of said chambers and being narrower than the diameter of either connected chamber, said trough being recessed into said body deeper than the deepest coin in both full stacks of coins within the connected chambers, said trough being for the purpose of viewing the edges of all coins in the two stacks, and for aiding finger or thumb access to the outermost coins' edges.

3. A coin dispenser from which a user urges out coins with his or her finger or thumb, and with which he or she can carry coins in a clothing pocket, comprising:

a body, a plurality of substantially cylindrical coin holding chambers for holding coins face to face in stacks with the coins' faces generally parallel to the largest orthogonal face of said body, the coins being axially movable in said chambers, a pair of ledges opposing each other affixed on said body at one end of each chamber for retaining the coins, all pairs of ledges being on one face of said body, each ledge protruding partway toward the center of its chamber, an opening in each chamber for an appropriate coin to slide radially beside said pair of ledges into and out of said chamber and said body, said opening being at one end of said pair of ledges, a land on the same face of said body on which said pairs of ledges are affixed, said land being recessed into said body beyond each pair of ledges and being at the opposite end of each pair of ledges from said opening, said land giving access of the edge of the outermost coin in an adjacent chamber to the urging finger or thumb of the dispenser's user, a cover attached to the face of said body that is opposite from the face having said pairs of ledges, an overall thickness dimension of the dispenser being less than the diameter of the largest diameter coin that can be carried in the dispenser, a floor being at the end of each chamber that is opposite said pair of ledges, a plate inside each chamber having a diameter slightly smaller than the diameter of its surrounding chamber, said plate located in-between said pair of ledges and said floor, a compression spring inside each chamber located in-between said floor and said plate for urging coins against said pair of ledges, a stub being centrally located on and fixed perpendicular to the face of each plate which is adjacent said spring, said stub having an axial length shorter than the diameter of the affixed plate, a sleeve fixed to the inside surface of said cover, said sleeve being centered within each chamber and being inside each spring, and a hole passing through each sleeve and continuing into said cover, said hole having a diameter slightly larger than the diameter of said stub, said stub being engaged with and axially slidable with said hole, said sleeve having a sufficient axial length and said cover being adequately thick whereby said sleeve and said cover substantially encompass said stub when said plate is depressed completely toward said floor, said stub and said hole being for the maintaining of said plate square with its surrounding chamber.

4. The coin dispenser of claim 3, further including:

a trough in said land entering each chamber opposite said opening, said trough being recessed into said body deeper than the deepest coin in a full stack of coins within the entered chamber, said trough being for the purpose of viewing the edges of all coins in the stack and for aiding finger or thumb access to the outermost coin's edge.

5. The coin dispenser of claim 3, further including:

a round cavity centrally located in the outside surface of said cover, and a round protrusion extending from said land and being coaxially centered with said cavity, said protrusion and said cavity being for the purpose of spinning the dispenser between a user's finger and thumb to quickly access different chambers.

6. The coin dispenser of claim 3, further including:

a round cavity centrally located in the outside surface of said cover, and a round dimple recessed into said land and being coaxially centered with said cavity, said dimple and said cavity being for the purpose of spinning the dispenser between a user's finger and thumb to quickly access different chambers.

7. The coin dispenser of claim 3 wherein said cover has a snap fit engagement with said body for the assembly of said cover with said body.

8. The coin dispenser of claim 3, further including:

a plurality of sides on the dispenser which are substantially perpendicular to the largest orthogonal face of said body, and a bevel between an outside surface of said cover and each side, said bevel terminating with said outside surface of said cover at a distance to each adjacent hole that is less than the diameter of said hole.

9. The coin dispenser of claim 8 wherein each bevel has a convex curved surface.

10. The coin dispenser of claim 3, further including:

a continuous side on the dispenser being substantially perpendicular to the largest orthogonal face of said body, and a bevel between an outside surface of said cover and said continuous side, said bevel terminating with said outside surface of said cover at a distance to each adjacent hole that is less than the diameter of said hole.

11. The coin dispenser of claim 10 wherein said bevel has a convex curved surface.

12. A coin dispenser from which a user urges out coins with his or her finger or thumb, and with which he or she can carry coins in a clothing pocket, comprising:

a body, a plurality of coin holding chambers for holding coins face to face in stacks with the coins' faces substantially parallel to the largest orthogonal face of said body, the coins being axially movable in said chambers, a pair of ledges opposing each other affixed on said body at one end of each chamber for retaining the coins, each ledge protruding partway toward the center of its chamber, an opening in each chamber for an appropriate coin to slide radially beside said pair of ledges into and out of said chamber and said body, a floor at the other end of each chamber, a plate inside each chamber having a diameter slightly smaller than the diameter of its surrounding chamber, said plate located in-between said pair of ledges and said floor, a spring inside each chamber located in-between said floor and said plate for urging coins against said pair of ledges, a stub being centrally located on and fixed perpendicular to the face of each plate which is adjacent said spring, said stub having an axial length shorter than the diameter of the affixed plate, a sleeve fixed to said floor and being inside each spring, said sleeve having an axial length approximately equal to the axial length of said stub, and a hole passing through each sleeve and being centered with its corresponding chamber, said hole having a diameter slightly larger than the diameter of said stub, said stub being engaged with and axially slidable with said hole, said stub and said hole being for the maintaining of said plate square with its surrounding chamber.

* * * * *